US006354486B1

(12) United States Patent
Ho

(10) Patent No.: US 6,354,486 B1
(45) Date of Patent: Mar. 12, 2002

(54) EXPANSIBLE DOCUMENT HOLDER

(76) Inventor: Chin-Lien Ho, No. 36, Lo-Yang Rd., Hsi-Tun Dist., Taichung City (TW)

( * ) Notice: Subject to any disclaimer, the term of this patent is extended or adjusted under 35 U.S.C. 154(b) by 0 days.

(21) Appl. No.: 09/688,245

(22) Filed: Oct. 16, 2000

(51) Int. Cl.[7] ..... B65D 27/28

(52) U.S. Cl. ..... 229/67.3; 40/359; 229/77; 229/84

(58) Field of Search ..... 229/928, 67.1, 229/67.2, 67.3, 67.4, 84, 77; 40/359

(56) References Cited

U.S. PATENT DOCUMENTS

| | | | | | |
|---|---|---|---|---|---|
| 646,638 | A | * | 4/1900 | Cutler | 229/928 |
| 1,042,488 | A | * | 10/1912 | Shaffer | 229/928 |
| 1,194,440 | A | * | 8/1916 | Swortfiguer | 229/928 |
| 1,478,248 | A | * | 12/1923 | Papparodis | 229/84 |
| RE23,029 | E | * | 8/1948 | Delson | 229/77 |
| 4,589,682 | A | | 5/1986 | Balland | |
| 5,865,469 | A | | 2/1999 | Chin | |
| 5,944,353 | A | | 8/1999 | Sato | |
| 5,947,524 | A | | 9/1999 | Podosek | |
| 5,993,099 | A | * | 11/1999 | Greenberg et al. | 229/67.2 |
| 6,039,473 | A | * | 3/2000 | Bond | 229/67.4 |

* cited by examiner

*Primary Examiner*—Stephen P. Garbe
(74) *Attorney, Agent, or Firm*—Baker Botts L.L.P.

(57) ABSTRACT

An expansible document holder includes a rectangular base wall, left and right lateral flaps connected to left and right lateral edges of the base wall, and lower and upper flaps connected to lower and upper edges of the base wall. The left and right lateral flaps and the lower and upper flaps are foldable relative to the base wall to a document confining position, wherein the left and right lateral flaps are superposed on the base wall, wherein the lower flap and the left and right lateral flaps overlie each other, wherein the upper flap overlies the left and right lateral flaps and the lower flap, and wherein the left and right lateral flaps, the lower and upper flaps and the base wall cooperatively confine a document confining space thereamong. The lower flap has opposite lateral portions that are disposed in an overlying manner with respect to the left and right lateral flaps in the document confining position. One of the left and right lateral flaps and the lateral portions of the lower flap in each overlying pair is formed with a tab slot. The other one of the left and right lateral flaps and the lateral portions of the lower flap in each overlying pair is provided with an anchoring tab that extends through the tab slot so as to inter-engage the lateral portions of the lower flap with the left and right lateral flaps.

13 Claims, 9 Drawing Sheets

EXPANSIBLE DOCUMENT HOLDER

BACKGROUND OF THE INVENTION

1. Field of the Invention

The invention relates to a document holder more particularly to an expansible document holder.

2. Description of the Related Art

FIGS. 1 and 2 illustrate a conventional document holder 1. The conventional document holder 1 includes a rectangular base wall 105 having left and right lateral edges and upper and lower edges, left and right lateral flaps 107 connected to the left and right lateral edges of the base wall 105 respectively along left and right folding lines 103, and lower and upper flaps 106, 104 connected to the lower and upper edges of the base wall 105 respectively along bottom and top folding lines 102, 101. The left and right lateral flaps 107 and the lower and upper flaps 106, 104 are foldable relative to the base wall 105, and cooperatively confine a document confining space thereamong. An elastic cord 108 has opposite ends anchored to the base wall 105, and includes left and right cord portions disposed on an outer surface of the base wall 105. The left and right cord portions are stretchable to overlie corner portions of the upper flap 104 so as to retain the upper and lower flaps 104, 106 and the left and right lateral flaps 107 in a document confining position, as best shown in FIG. 2. However, the cord portions of the elastic cord 108 are easily removed from the upper flap 104 when the conventional document holder 1 is being carried. Moreover, the conventional document holder 1 cannot receive a relatively large amount of documents, thereby resulting in inconvenience during use.

SUMMARY OF THE INVENTION

Therefore, the object of the present invention is to provide an expansible document holder that permits secure engagement between left and right lateral flaps and a lower flap.

According to the present invention, an expansible document holder includes a rectangular base wall, left and right lateral flaps, and lower and upper flaps.

The rectangular base wall has left and right lateral edges opposite to each other in a longitudinal direction, and upper and lower edges opposite to each other in a first transverse direction that is transverse to the longitudinal direction. The base wall further has inner and outer surfaces opposite to each other in a second transverse direction that is transverse to both the longitudinal direction and the first transverse direction.

The left and right lateral flaps are connected to the left and right lateral edges of the base wall respectively along first left and right folding lines that extend in the first transverse direction.

The lower and upper flaps are connected to the lower and upper edges of the base wall respectively along first bottom and top folding lines that extend in the longitudinal direction.

The left and right lateral flaps and the lower and upper flaps are foldable relative to the base wall to a document confining position, wherein the left and right lateral flaps are superposed on the inner surface of the base wall, wherein the lower flap and the left and right lateral flaps overlie each other, wherein the upper flap overlies the left and right lateral flaps and the lower flap, and wherein the left and right lateral flaps, the lower and upper flaps and the base wall cooperatively confine a document confining space thereamong.

The lower flap has opposite lateral portions that are disposed in an overlying manner with respect to the left and right lateral flaps in the document confining position. One of the left and right lateral flaps and the lateral portions of the lower flap in each overlying pair is formed with a tab slot. The other one of the left and right lateral flaps and the lateral portions of the lower flap in each overlying pair is provided with an anchoring tab that extends through the tab slot so as to inter-engage the lateral portions of the lower flap with the left and right lateral flaps.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
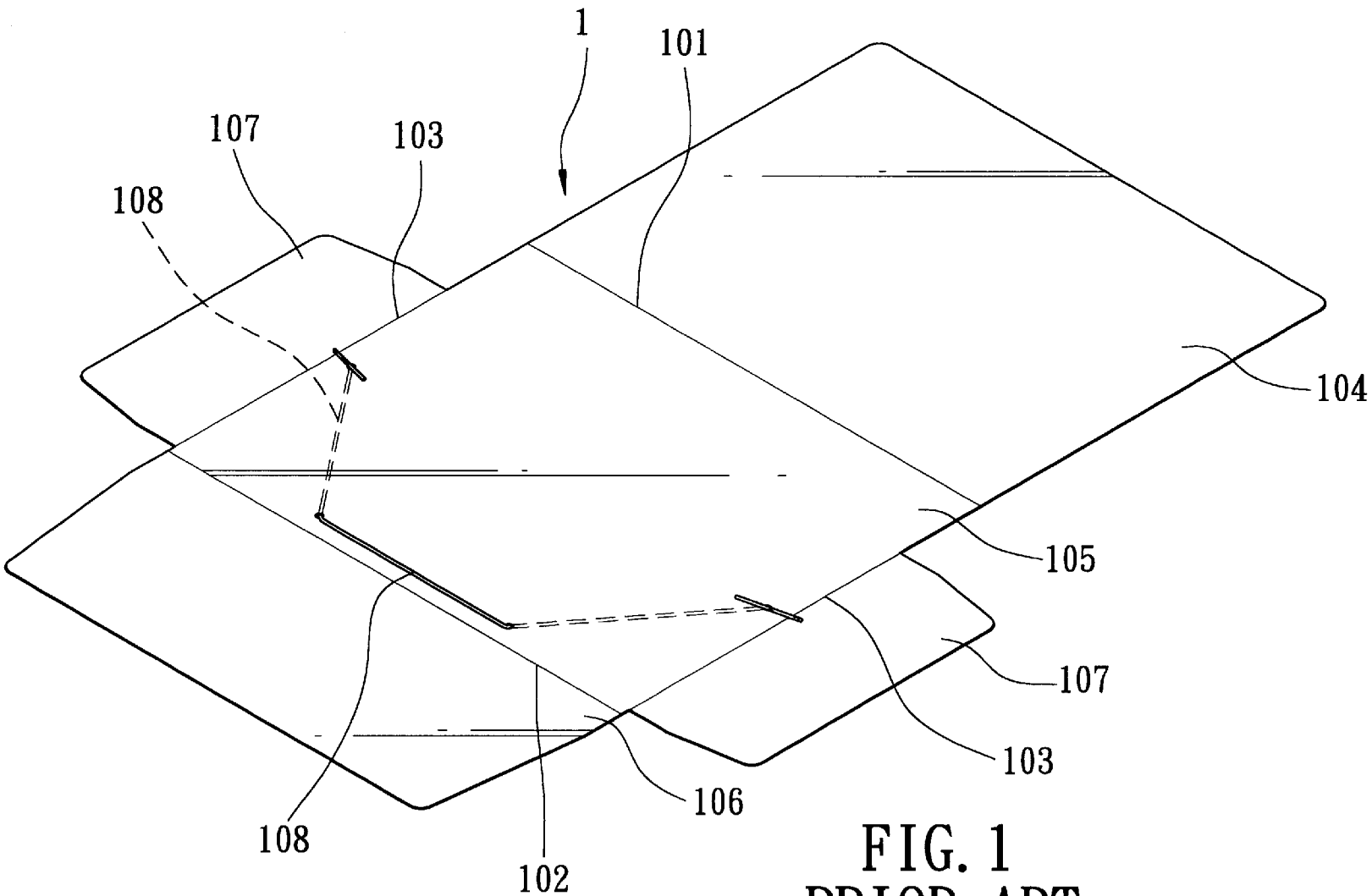
FIG. 1 PRIOR ART
FIG. 1 is a schematic view showing a conventional document holder in an unfolded state.
Figure 2:
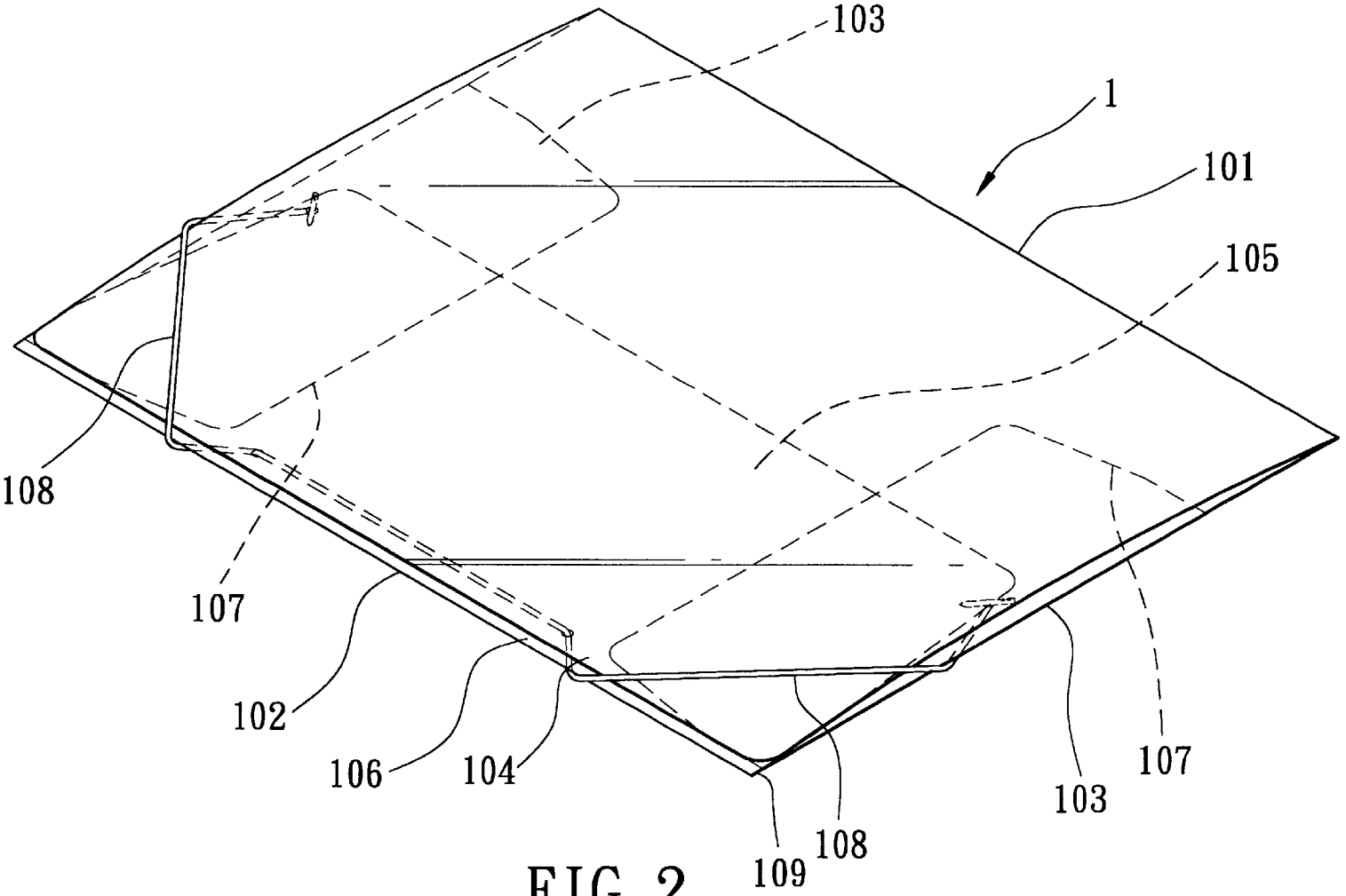
FIG. 2 PRIOR ART
FIG. 2 is a perspective view of the conventional document holder.
Figure 3:
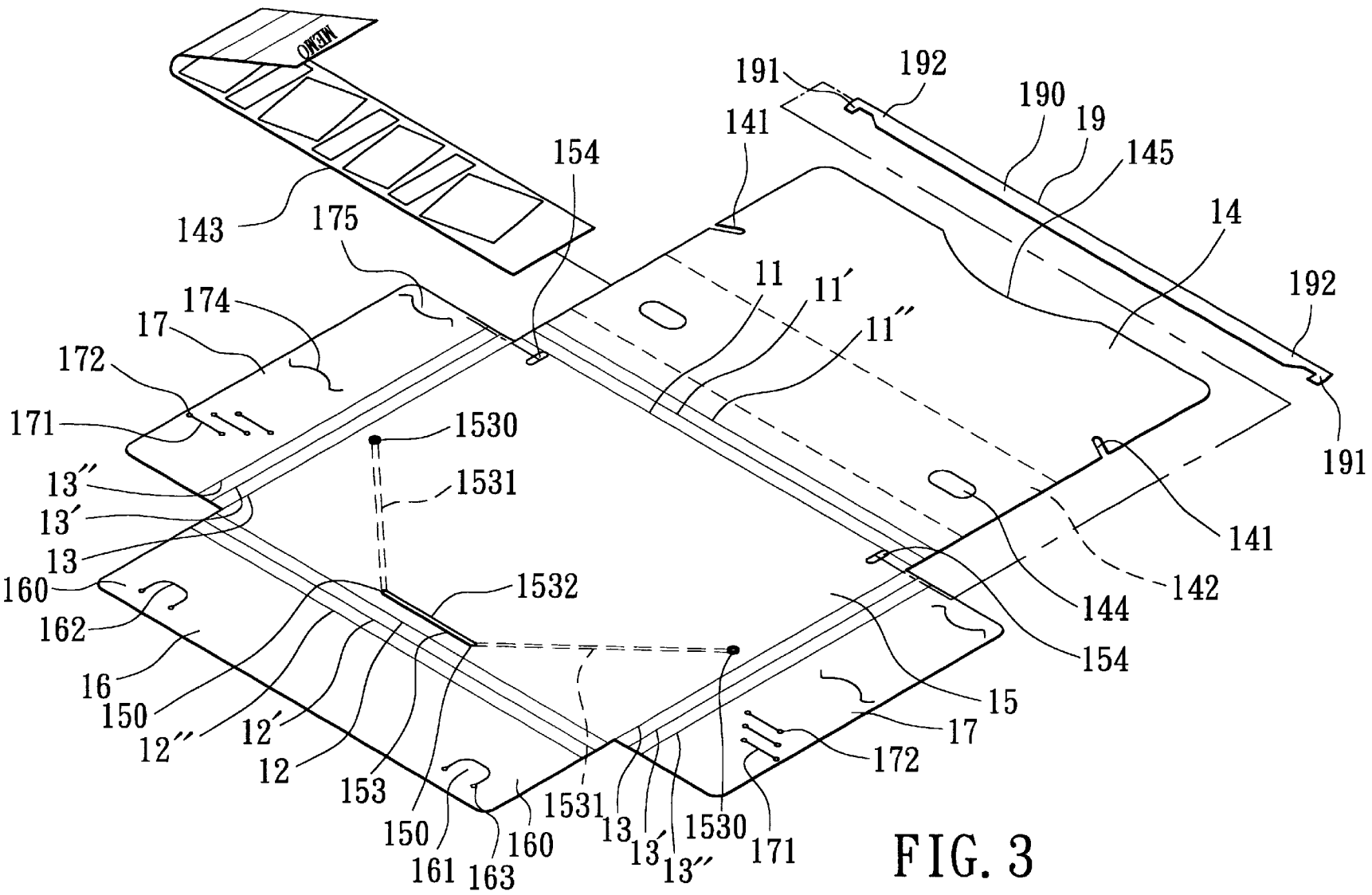
FIG. 3 is an exploded perspective view of the preferred embodiment of an expansible document holder according to this invention.
Figure 4:
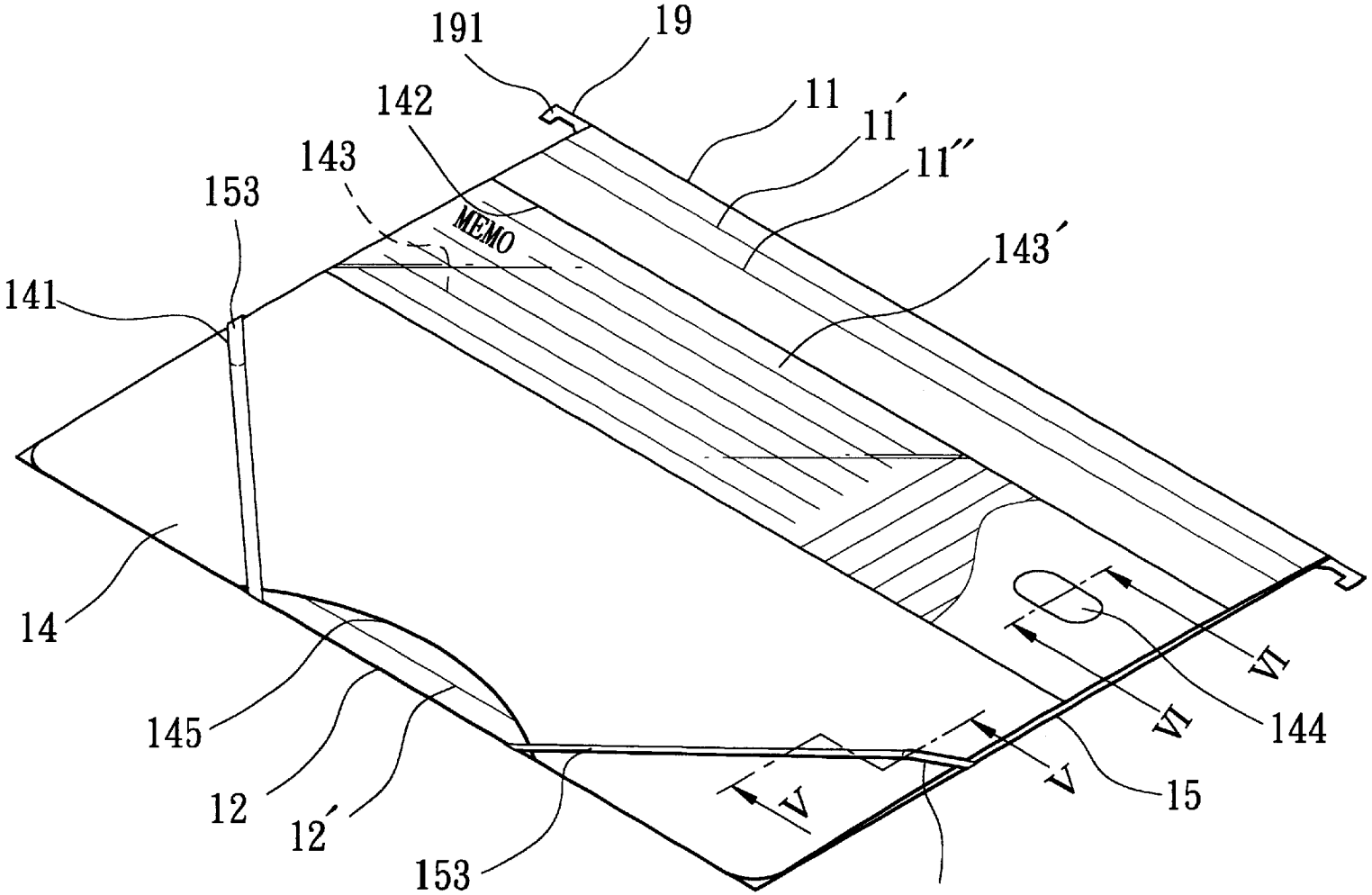
FIG. 4 is a perspective view of the preferred embodiment.

Referring to FIGS. 3 and 4, according to the preferred embodiment of this invention, an expansible document holder is shown to include a rectangular base 15, left and right lateral flaps 17, lower and upper flaps 16, 14, an elastic cord unit 153, and a hanging rod 19.

The base wall 15 has left and right lateral edges opposite to each other in a longitudinal direction, and upper and lower edges opposite to each other in a first transverse direction that is transverse to the longitudinal direction. The base wall 15 further has inner and outer surfaces opposite to each other in a second transverse direction that is transverse to both the longitudinal direction and the first transverse direction.

Figure 7:
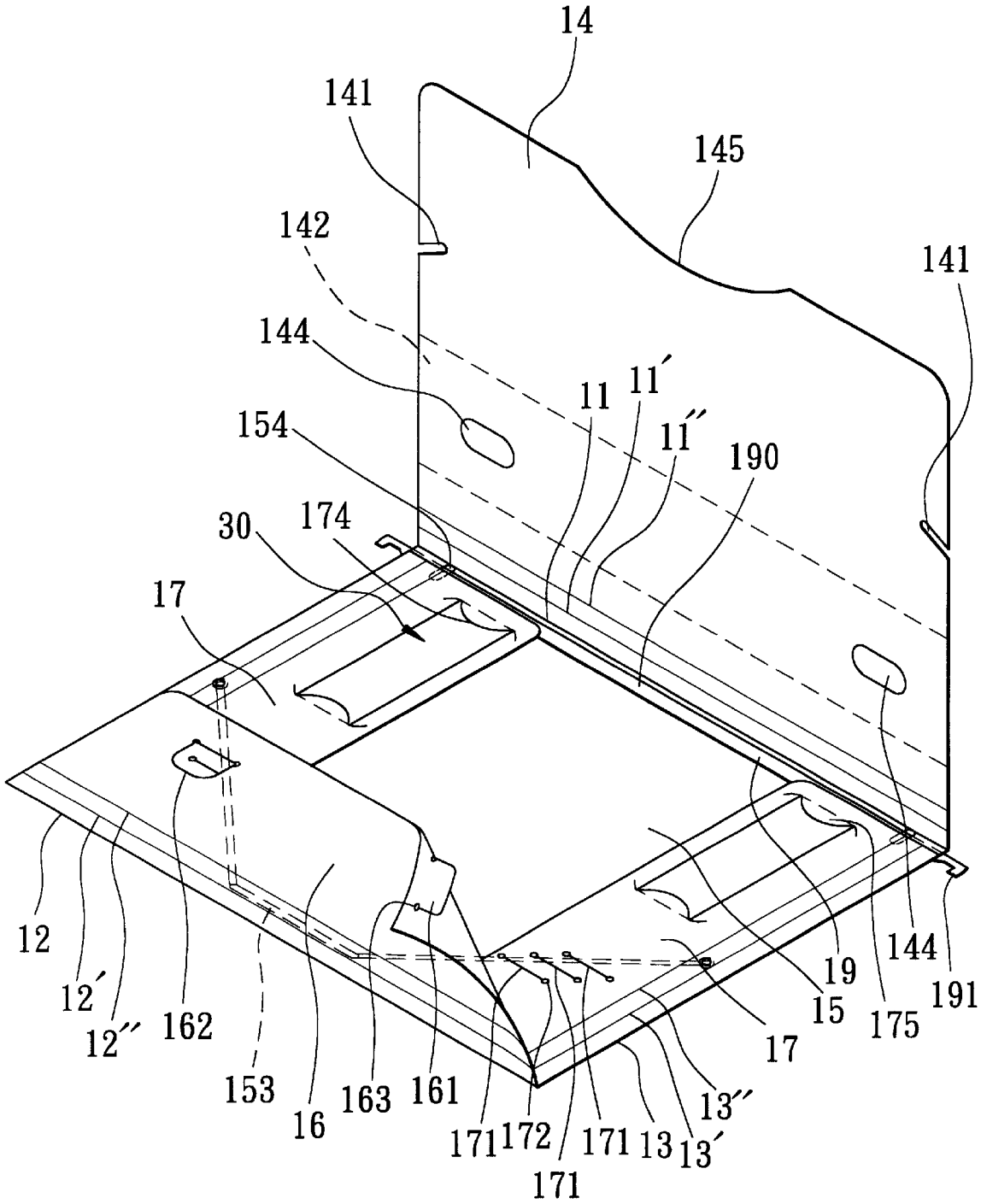
FIG. 7 is a perspective view of the preferred embodiment in a state of use.

The left and right lateral flaps 17 are connected to the left and right lateral edges of the base wall 15 respectively along first left and right folding lines 13 that extend in the first transverse direction. The left lateral flap 17 is further provided with a plurality of second left folding lines 13', 13" parallel to the first left folding line 13 for selectively folding the left lateral flap 17 relative to the base wall 15 therealong. The right lateral flap 17 is further provided with a plurality of second right folding lines 13', 13" parallel to the first right folding line 13 for selectively folding the right lateral flap 17 relative to the base wall 15 therealong. Each of the left and right lateral flaps 17 is formed with a pair of curved card slots 174 that curve toward each other, thereby forming a pair of card clipping tabs 175 that are adapted for clipping a periphery of a name card 30, as shown in FIG. 7. The card slots 174 are spaced apart from each other in a lengthwise direction parallel to the first transverse direction.

The lower and upper flaps 16, 14 are connected to the lower and upper edges of the base wall 15 respectively along first bottom and top folding lines 12, 11 that extend in the longitudinal direction. The lower flap 16 is further provided with a plurality of second bottom folding lines 12', 12" parallel to the first bottom folding line 12 for selectively folding the lower flap 16 relative to the base wall 15 therealong. The upper flap 14 is further provided with a plurality of second top folding lines 11', 11" parallel to the first top folding line 11 for selectively folding the upper flap 14 relative to the base wall 15 therealong.

Figure 5:
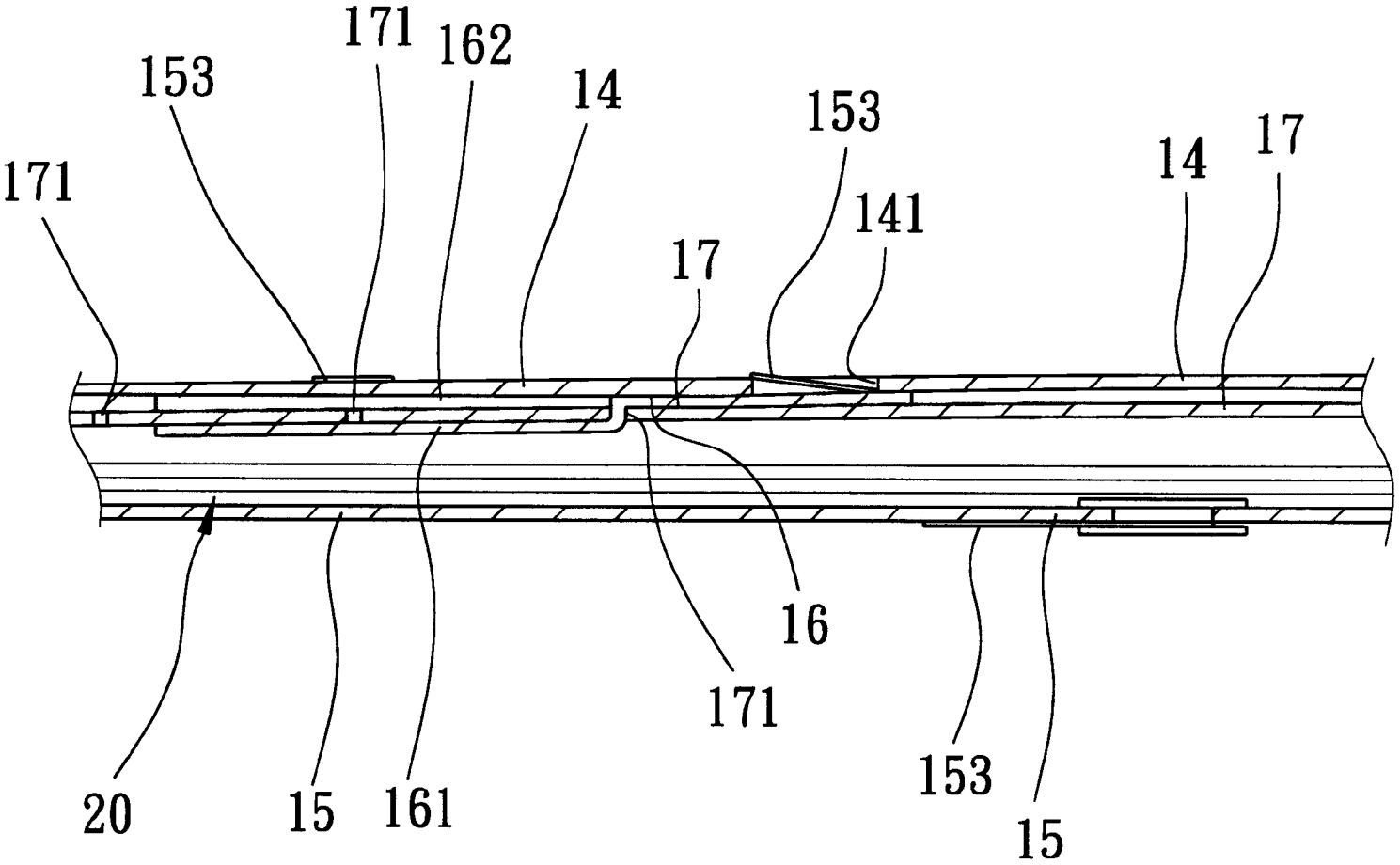
FIG. 5 is a fragmentary sectional view of the preferred embodiment taken along line V—V in FIG. 4.

The left and right lateral flaps 17 and the lower and upper flaps 16, 14 are foldable relative to the base wall 15 to a document confining position, as shown in FIG. 5, wherein the left and right lateral flaps 17 are superposed on the inner surface of the base wall 15, wherein the lower flap 16 overlies the left and right lateral flaps 17, wherein the upper flap 14 overlies the left and right lateral flaps 17 and the lower flap 16, and wherein the left and right lateral flaps 17, the lower and upper flaps 16, 14 and the base wall 15 cooperatively confine a document confining space thereamong.

Figure 6:
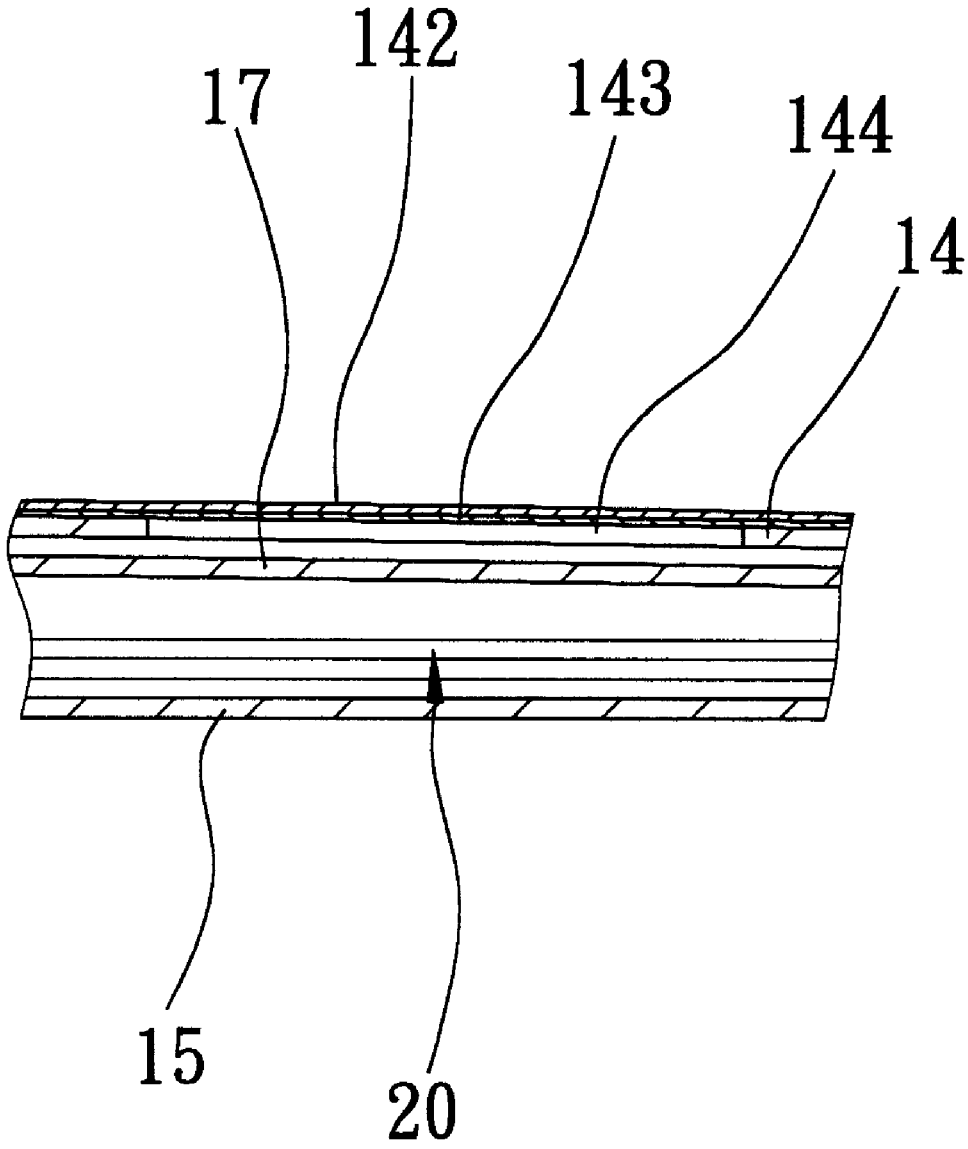
FIG. 6 is a fragmentary sectional view of the preferred embodiment taken along line VI—VI in FIG. 4.

The lower flap 16 has opposite lateral portions 160 that respectively overlie the left and right lateral flaps 17 in the document confining position, as shown in FIG. 7. The left and right lateral flaps 17 in each overlying pair is formed with a plurality of tab slots 171 that are spaced apart from each other in a lengthwise direction parallel to the first transverse direction. Each of the tab slots 171 extends in a widthwise direction parallel to the longitudinal direction, and has opposite rounded ends 172. The lateral portions 160 of the lower flap 16 in each overlying pair is provided with an anchoring tab 161 that extends through a selected one of the tab slots 171 in accordance with the thickness of documents 20 to be received in the document confining space so as to inter-engage the lateral portions 160 of the lower flap 16 with the left and right lateral flaps 17, as shown in FIGS. 6 and 7. The lateral portions 160 of the lower flap 16 in each overlying pair is formed with a rectangular cut-out 162. The anchoring tab 161 is disposed in the cut-out 162, and has one edge connected hingeably to a periphery of the cut-out 162. The periphery of the cut-out 162 is formed with a pair of perforations 163 at opposite sides of the anchoring tab 161 to avoid tearing of the anchoring tab 161 from the periphery of the cut-out 162.

Figure 8:
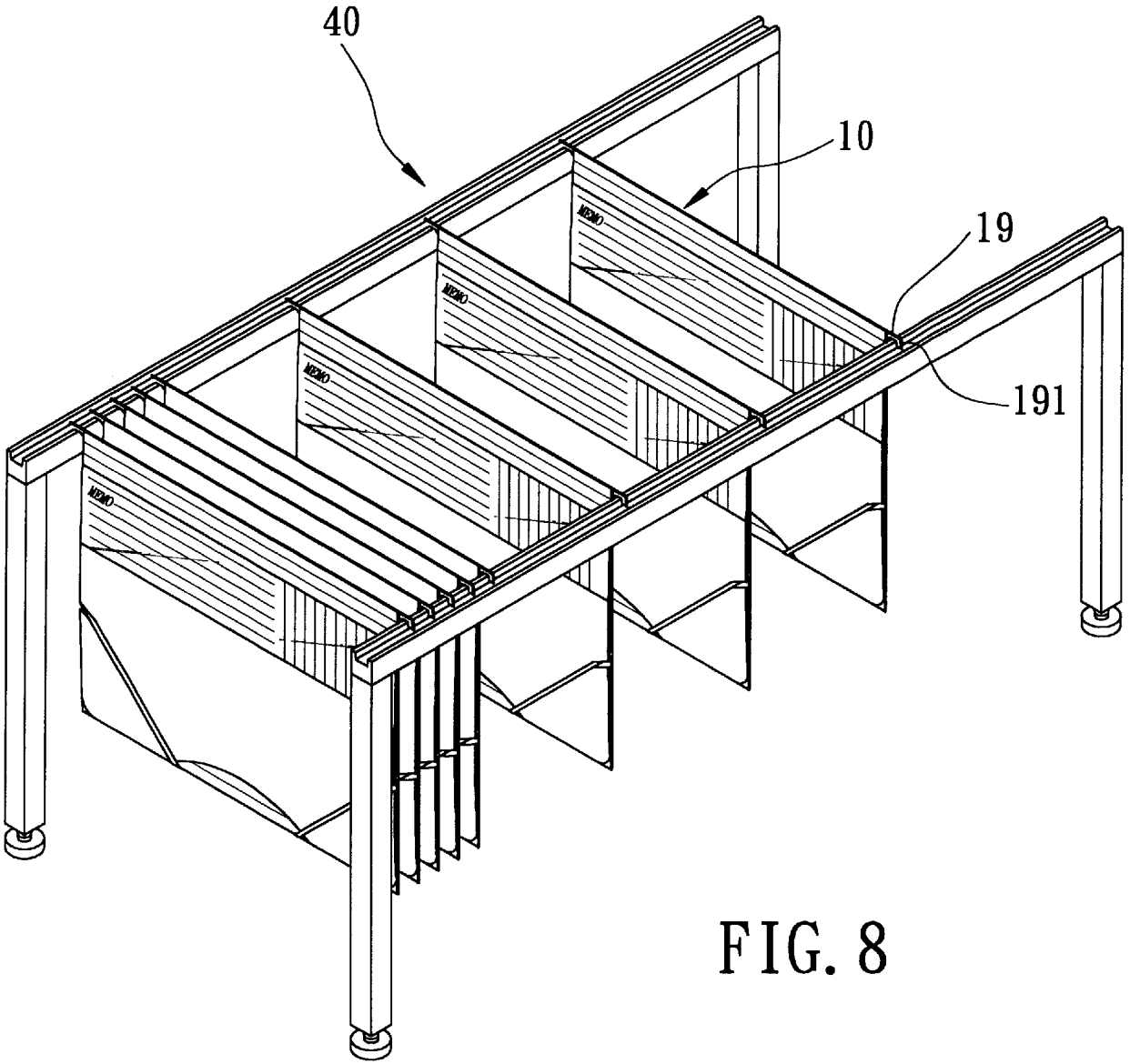
FIG. 8 is a perspective view illustrating the preferred embodiment in a filing state.

The base wall 15 is formed with a pair of rod holes 154 that extend in the second transverse direction and that are spaced apart from each other in the longitudinal direction. The rod holes 154 are disposed proximate to the first top folding line 11. The hanging rod 19 has an intermediate rod section 190 disposed on the inner surface of the base wall 15, and opposite end sections 192. Each of the end sections 192 extends from a respective one of opposite ends of the intermediate rod section 190, and extends through a respective one of the rod holes 154 so as to be disposed on the outer surface of the base wall 15. As shown in FIGS. 4 and 7, each of the end sections 192 projects in the longitudinal direction beyond a respective one of the left and right lateral edges of the base wall 15, and is formed with a distal hook end 191 that is adapted to be hooked and engaged on a frame 40 for filing management, as shown in FIG. 8.

The base wall 15 is further formed with a pair of cord holes 150 that extend in the second transverse direction and that are spaced apart from each other in the longitudinal direction. The cord holes 150 are disposed proximate to an intermediate section of the first bottom folding line 12. The elastic cord unit 153 includes left and right cord portions 1531 disposed on the outer surface of the base wall 15, and an intermediate cord portion 1532 disposed on the inner surface of the base wall 15. The left cord portion 1531 has a first end 1530 anchored to the base wall 15 proximate to an intermediate section of the first left folding line 13, and a second end that extends through one of the cord holes 150. The right cord portion 1531 has a first end anchored to the base wall 15 proximate to an intermediate section of the first right folding line 13, and a second end that extends through the other one of the cord holes 150. The intermediate cord portion 1532 interconnects the second ends of the left and right cord portions 1531. As shown in FIGS. 4 and 5, the left and right cord portions 1531 are stretchable to overlie corner portions of the upper flap 14 to retain the left and right lateral flaps 17 and the lower and upper flaps 16, 14 in the document confining position. The upper flap 14 has opposite lateral edges, each of which is formed with a cord notch 141 for engaging a respective one of the left and right cord portions 1531.

The upper flap 14 has an outer surface with a transparent sheet 142 attached thereto to form a label pocket that is adapted to receive a label 143 therein. The label 143 has a first surface provided with a memo region that is visible via the transparent sheet 142, as shown in FIG. 4, and a second surface opposite to the first surface and provided with operating instructions. The upper flap is further formed with a pair of finger holes 144 spaced apart from each other in the lengthwise direction parallel to the longitudinal direction. As shown in FIG. 6, the finger holes 144 are communicated with the label pocket to facilitate removal of the label 143 from the label pocket. Moreover, the upper flap 14 has a peripheral edge remote from the first top folding line 11 and formed with a curved notch 145 to facilitate raising the upper flap 14 from the lower flap 16.

Figure 9:
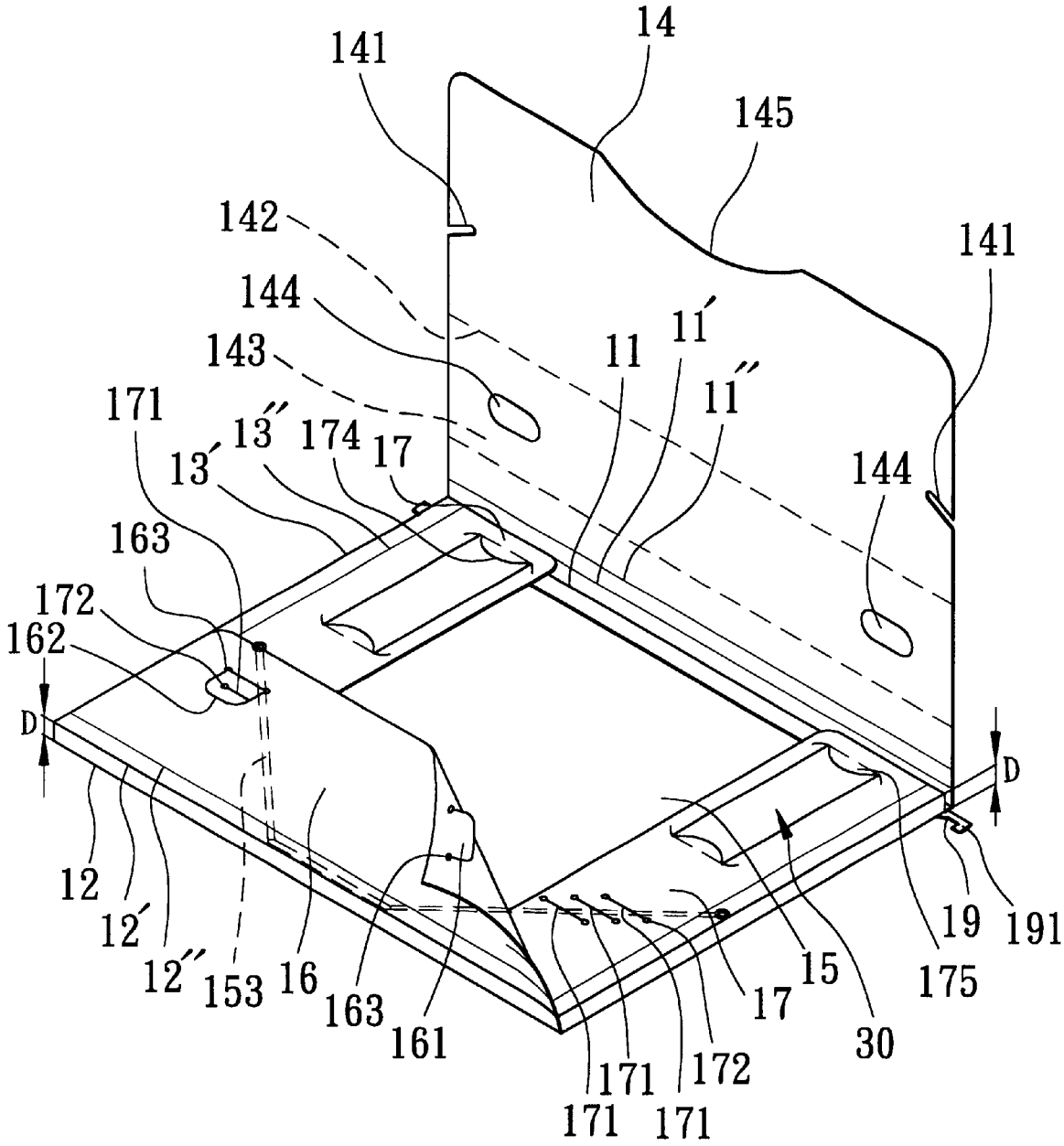
FIG. 9 is a perspective view illustrating the preferred embodiment in another state of use.

FIG. 9 illustrates the preferred embodiment in another state of use. In this embodiment, the left and right lateral flaps 17 and the lower and upper flaps 16, 14 are folded relative to the base wall 15 along the second left and right folding lines 13' and the second bottom and top folding lines 12', 11' so as to configure the document confining space with a depth (D), which enables a larger amount of documents to be received therein than that of the document confining space of FIG. 4.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An expansible document holder comprising:

a rectangular base wall having left and right lateral edges opposite to each other in a longitudinal direction, and upper and lower edges opposite to each other in a first transverse direction that is transverse to the longitudinal direction, said base wall further having inner and outer surfaces opposite to each other in a second transverse direction that is transverse to both the longitudinal direction and the first transverse direction;

left and right lateral flaps connected to said left and right lateral edges of said base wall respectively along first left and right folding lines that extend in the first transverse direction; and lower and upper flaps connected to said lower and upper edges of said base wall respectively along first bottom and top folding lines that extend in the longitudinal direction;

said left and right lateral flaps and said lower and upper flaps being foldable relative to said base wall to a document confining position, wherein said left and right lateral flaps are superposed on said inner surface of said base wall, wherein said lower flap and said left and right lateral flaps overlie each other, wherein said upper flap overlies said left and right lateral flaps and said lower flap, and wherein said left and right lateral flaps, said lower and upper flaps and said base wall cooperatively define a document confining space thereamong;

wherein said lower flap has opposite lateral portions that are disposed in an overlying manner with respect to said left and right lateral flaps in the document confining position, one of said left and right lateral flaps and said lateral portions of said lower flap in each overlying pair being formed with a tab slot, the other one of said left and right lateral flaps and said lateral portions of said lower flap in each overlying pair being provided with an anchoring tab that extends through said tab slot so as to inter-engage said lateral portions of said lower flap with said left and right lateral flaps, wherein the other one of said left and right lateral flaps and said lateral portions of said lower flap in each overlying pair is formed with a rectangular cut-out, said anchoring tab being disposed in said cut-out and having one edge connected hingeably to a periphery of said cut-out.

2. The expansible document holder of claim 1, wherein the periphery of said cut-out is formed with a pair of perforations at opposite sides of said anchoring tab to avoid tearing of said anchoring tab from the periphery of said cut-out.

3. The expansible document holder of claim 1, wherein said tab slot extends in a widthwise direction parallel to the longitudinal direction.

4. The expansible document holder of claim 3, wherein said tab slot has opposite rounded ends.

5. The expansible document holder of claim 3, wherein said one of said left and right lateral flaps and said lateral portions of said lower flap in each overlying pair is formed with a plurality of said tab slots that are spaced apart from each other in a lengthwise direction parallel to the first transverse direction for selective engagement with said anchoring tab.

6. An expansible document holder comprising:

a rectangular base wall having left and right lateral edges opposite to each other in a longitudinal direction, and upper and lower edges opposite to each other in a first transverse direction that is transverse to the longitudinal direction, said base wall further having inner and outer surfaces opposite to each other in a second transverse direction that is transverse to both the longitudinal direction and the first transverse direction;

left and right lateral flaps connected to said left and right lateral edges of said base wall respectively along first left and right folding lines that extend in the first transverse direction;

lower and upper flaps connected to said lower and upper edges of said base wall respectively along first bottom and top folding lines that extend in the longitudinal direction;

said left and right lateral flaps and said lower and upper flaps being foldable relative to said base wall to a document confining position, wherein said left and right lateral flaps are superposed on said inner surface of said base wall, wherein said lower flap and said left and right lateral flaps overlie each other, wherein said upper flap, overlies said left and right lateral flaps and said lower flap, and wherein said left and right lateral flaps, said lower and upper flaps and said base wall cooperatively define a document confining space thereamong; wherein said lower flap has opposite lateral portions that are disposed in an overlying manner with respect to said left and right lateral flaps in the document confining position, one of said left and right lateral flaps and said lateral portions of said lower flap in each overlying pair being formed with a tab slot, the other one of said left and right lateral flaps and said lateral portions of said lower flap in each overlying pair being provided with an anchoring tab that extends through said tab slot so as to inter-engage said lateral portions of said lower flap with said left and right lateral flaps, wherein said base wall is formed with a pair of rod holes that extend in the second transverse direction and that are spaced apart from each other in the longitudinal direction, said rod holes being disposed proximate to said first top folding line, said expansible document holder further comprising a hanging rod having an intermediate rod section disposed on said inner surface of said base wall, and opposite end sections that extend from said intermediate rod section and that extend through a respective one of said rod holes so as to be disposed on said outer surface of said base wall.

7. The expansible document holder of claim 6, wherein each of said end sections of said hanging rod projects in the longitudinal direction beyond a respective one of said left and right lateral edges of said base wall, and is formed with a distal hook end.

8. An expansible document holder comprising:

a rectangular base wall having left and right lateral edges opposite to each other in a longitudinal direction, and upper and lower edges opposite to each other in a first transverse direction that is transverse to the longitudinal direction, said base wall further having inner and outer surfaces opposite to each other in a second transverse direction that is transverse to both the longitudinal direction and the first transverse direction;

left and right lateral flaps connected to said left and right lateral edges of said base wall respectively along first left and right folding lines that extend in the first transverse direction; and lower and upper flaps connected to said lower and upper edges of said base wall respectively along first bottom and top folding lines that extend in the longitudinal direction;

said left and right lateral flaps and said lower and upper flaps being foldable relative to said base wall to a document confining position, wherein said left and right lateral flaps are superposed on said inner surface of said base wall, wherein said lower flap and said left and right lateral flaps overlie each other, wherein said upper flap overlies said left and right lateral flaps and said lower flap, and wherein said left and right lateral flaps, said lower and upper flaps and said base wall cooperatively define a document confining space thereamong;

wherein said lower flap has opposite lateral portions that are disposed in an overlying manner with respect to said left and right lateral flaps in the document confining position, one of said left and right lateral flaps and said lateral portions of said lower flap in each overlying pair being formed with a tab slot, the other one of said left and right lateral flaps and said lateral portions of said lower flap in each overlying pair being provided with an anchoring tab that extends through said tab slot so as to inter-engage said lateral portions of said lower flap with said left and right lateral flaps, wherein at least one of said left and right lateral flaps is provided with a retaining unit adapted for retaining a name card thereon.

9. An expansible document holder comprising:

a rectangular base wall having left and right lateral edges opposite to each other in a longitudinal direction, and upper and lower edges opposite to each other in a first transverse direction that is transverse to the longitudinal direction, said base wall further having inner and outer surfaces opposite to each other in a second transverse direction that is transverse to both the longitudinal direction and the first transverse direction;

left and right lateral flaps connected to said left and right lateral edges of said base wall respectively along first left and right folding lines that extend in the first transverse direction; and lower and upper flaps connected to said lower and upper edges of said base wall respectively along first bottom and top folding lines that extend in the longitudinal direction;

said left and right lateral flaps and said lower and upper flaps being foldable relative to said base wall to a document confining position, wherein said left and right lateral flaps are superposed on said inner surface of said base wall, wherein said lower flap and said left and right lateral flaps overlie each other, wherein said upper flap overlies said left and right lateral flaps and said lower flap, and wherein said left and right lateral flaps, said lower and upper flaps and said base wall cooperatively define a document confining space thereamong;

wherein said lower flap has opposite lateral portions that are disposed in an overlying manner with respect to said left and right lateral flaps in the document confining position, one of said left and right lateral flaps and said lateral portions of said lower flap in each overlying pair being formed with a tab slot, the other one of said left and right lateral flaps and said lateral portions of said lower flap in each overlying pair being provided with an anchoring tab that extends through said tab slot so as to inter-engage said lateral portions of said lower flap with said left and right lateral flaps, wherein at least one of said left and right lateral flaps is formed with a pair of curved card slots that curve toward each other, thereby forming a pair of card clipping tabs that are adapted for clipping a periphery of a name card.

10. The expansible document holder of claim 9, wherein said card slots are spaced apart from each other in a lengthwise direction parallel to the first transverse direction.

11. An expansible document holder comprising:

a rectangular base wall having left and right lateral edges opposite to each other in a longitudinal direction, and upper and lower edges opposite to each other in a first transverse direction that is transverse to the longitudinal direction, said base wall further having inner and outer surfaces opposite to each other in a second transverse direction that is transverse to both the longitudinal direction and the first transverse direction;

left and right lateral flaps connected to said left and right lateral edges of said base wall respectively along first left and right folding lines that extend in the first transverse direction; and lower and upper flaps connected to said lower and upper edges of said base wall respectively along first bottom and top folding lines that extend in the longitudinal direction;

said left and right lateral flaps and said lower and upper flaps being foldable relative to said base wall to a document confining position, wherein said left and right lateral flaps are superposed on said inner surface of said base wall, wherein said lower flap and said left and right lateral flaps overlie each other, wherein said upper flap overlies said left and right lateral flaps and said lower flap, and wherein said left and right lateral flaps, said lower and upper flaps and said base wall cooperatively define a document confining space thereamong;

wherein said lower flap has opposite lateral portions that are disposed in an overlying manner with respect to said left and right lateral flaps in the document confining position, one of said left and right lateral flaps and said lateral portions of said lower flap in each overlying pair being formed with a tab slot, the other one of said left and right lateral flaps and said lateral portions of said lower flap in each overlying pair being provided with an anchoring tab that extends through said tab slot so as to inter-engage said lateral portions of said lower flap with said left and right lateral flaps, wherein said upper flap has an outer surface with a transparent sheet attached thereto to form a label pocket that is adapted to receive a label therein.

12. The expansible document holder of claim 11, wherein said upper flap is further formed with at least one finger hole that is communicated with said label pocket to facilitate removal of the label from said label pocket.

13. An expansible document holder comprising:

a rectangular base wall having left and right lateral edges opposite to each other in a longitudinal direction, and upper and lower edges opposite to each other in a first transverse direction that is transverse to the longitudinal direction, said base wall further having inner and outer surfaces opposite to each other in a second transverse direction that is transverse to both the longitudinal direction and the first transverse direction;

left and right lateral flaps connected to said left and right lateral edges of said base wall respectively along first left and right folding lines that extend in the first transverse direction; and lower and upper flaps connected to said lower and upper edges of said base wall respectively along first bottom and top folding lines that extend in the longitudinal direction;

said left and right lateral flaps and said lower and upper flaps being foldable relative to said base wall to a document confining position, wherein said left and right lateral flaps are superposed on said inner surface of said base wall, wherein said lower flap and said left and right lateral flaps overlie each other, wherein said upper flap overlies said left and right lateral flaps and said lower flap, and wherein said left and right lateral flap, said lower and upper flaps and said base wall cooperatively define a document confining space thereamong;

wherein said lower flap has opposite lateral portions that are disposed in an overlying manner with respect to said left and right lateral flaps in the document confining position, one of said left and right lateral flaps and said lateral portions of said lower flap in each overlying pair being formed with a tab slot, the other one of said left and right lateral flaps and said lateral portions of said lower flap in each overlying pair being provided with an anchoring tab that extends through said tab slot so as to inter-engage said lateral portions of said lower flap with said left and right lateral flaps, wherein said upper flap has a peripheral edge remote from said first top folding line and formed with a curved notch.

* * * * *